US007374213B2

(12) United States Patent
Carlson

(10) Patent No.: US 7,374,213 B2
(45) Date of Patent: May 20, 2008

(54) SECURITY DOOR STOP

(75) Inventor: Steve B. Carlson, North Las Vegas, NV (US)

(73) Assignee: Carneill Solutions, LLC, Las Vegas, NV (US)

( * ) Notice: Subject to any disclaimer, the term of this patent is extended or adjusted under 35 U.S.C. 154(b) by 0 days.

(21) Appl. No.: 11/537,321

(22) Filed: Sep. 29, 2006

(65) Prior Publication Data

US 2008/0079270 A1 Apr. 3, 2008

(51) Int. Cl.
*E05C 17/54* (2006.01)

(52) U.S. Cl. ..... 292/343

(58) Field of Classification Search ..... 292/343, 292/342, 288; 16/82, 375
See application file for complete search history.

(56) References Cited

U.S. PATENT DOCUMENTS 3,174,179 A * 3/1965 Benson ..... 16/375
4,648,152 A * 3/1987 Grewall ..... 16/82
4,738,002 A 4/1988 Shank
4,831,688 A 5/1989 Deininger
4,858,273 A 8/1989 Civitelli
5,027,471 A 7/1991 Barnes
5,044,681 A 9/1991 Neighbors
5,450,652 A 9/1995 Webb
5,511,837 A * 4/1996 Dempsey et al. ..... 292/288
5,560,080 A * 10/1996 Reed ..... 16/82

FOREIGN PATENT DOCUMENTS

FR 2485073 A1 * 6/1980

* cited by examiner

*Primary Examiner*—Patricia Engle
*Assistant Examiner*—Kristina R Gluchowski
(74) *Attorney, Agent, or Firm*—Fredrikson & Byron, P.A.

(57) ABSTRACT

In some aspects, the invention features a door stop. In some embodiments, the door stop can be used to lock doors open. The door stop can include a base having first and second contact surfaces. The base can be positionable in an open position. In the open position, the first contact surface can contact a door jamb, a first hinge plate, or both. In the open position, the second contact surface can contact a hinged edge of a door, a second hinge plate, or both. The base can include a third contact surface. The third contact surface can be configured to contact a frame stop when the base is positioned in the open position. The third contact surface can be generally perpendicular to the first contact surface.

17 Claims, 6 Drawing Sheets

SECURITY DOOR STOP

TECHNICAL FIELD

This document relates to door stops.

BACKGROUND

Door stops for maintaining doors in an open position have existed for some time. Door stops have many applications. Fire fighters often use them to prop open doors while fighting fires to make sure that equipment (e.g., hoses) and people are able to move from room to room without hindrance.

Door stops can also be used for security purposes. People tend to be less likely to engage in illicit conduct if they know that their conduct is not entirely private. Based on this principle, propping doors open with door stops can enhance security in some circumstances. For example, hotel maids are often instructed to prop doors open while cleaning hotel rooms in order to guard against the possibility of a person following them into a room, closing the door, and attacking them.

SUMMARY

In one aspect, the invention features a door stop. The door stop can include a base having first and second contact surfaces. The base can be positionable in an open position. In the open position, the first contact surface can contact a door jamb, a first hinge plate, or both. In the open position, the second contact surface can contact a hinged edge of a door, a second hinge plate, or both. The base can be lockable in the open position.

In a second aspect, the invention features a door stop. The door stop can include a base having first, second, and third contact surfaces. The base can be positionable in an open position. In the open position, the first contact surface can contact a door jamb, a first hinge plate, or both. In the open position, the second contact surface can contact a hinged edge of a door, a second hinge plate, or both. In the open position, the third contact surface can contact a frame stop. The third contact surface can be generally perpendicular to the first surface.

In a third aspect, the invention features a door stop. The door stop can include a base having first and second contact surfaces. The base can be positionable in an open position. In the open position, the first contact surface can contact a door jamb, a first hinge plate, or both. In the open position, the second contact surface can contact a hinged edge of a door, a second hinge plate, or both. The door stop can include locking means for locking the base in the open position.

Embodiments of the invention can include a variety of base configurations. The first contact surface can be generally perpendicular to the second contact surface. The base can be generally symmetrical about an axis that makes an approximately 45-degree angle with both the first and second contact surfaces. The base can include a third contact surface. The third contact surface can be configured to contact a frame stop when the base is positioned in the open position. The third contact surface can be generally perpendicular to the first contact surface. The base can include a fourth contact surface. The fourth contact surface can be configured to contact the frame stop when the base is positioned in the open position. The fourth contact surface can be generally parallel to the first contact surface. The base can include an internal locking mechanism.

Embodiments of the invention can include fastening means for confining a hinge when the base is in the open position. The door stop can include a first fastening member rigidly coupled to the base. The door stop can include a second fastening member slidably coupled to the base. The first and second fastening members can be configured to confine a hinge when the base is in the open position. The first fastening member can be configured to confine an upper portion of the hinge. The second fastening member can be configured to confine a lower portion of the hinge. A locking mechanism can be coupleable to the second fastening member. Varying sizes of hinges can be confined.

Embodiments of the present invention may have one or more of the following advantages. In some embodiments, the door stop can be locked, thereby making it more difficult for a person to close the door for purposes of engaging in illicit conduct. Some embodiments can be relatively easy to lock and unlock, thereby increasing the likelihood that they will be used as instructed. Some embodiments may ease stress on the hinge by resisting the base's tendency to move away from the hinge post during use in one or more ways other than pulling on the hinge. Some embodiments may be made of material that is relatively light yet maintains structural integrity during use.

DETAILED DESCRIPTION OF ILLUSTRATIVE EMBODIMENTS

The following detailed description of illustrative embodiments should be read with reference to the figures, in which like elements in different figures are numbered identically. The figures depict illustrative embodiments and are not intended to limit the scope of the invention. Rather, the present invention is defined solely by the claims.

Figure 1:
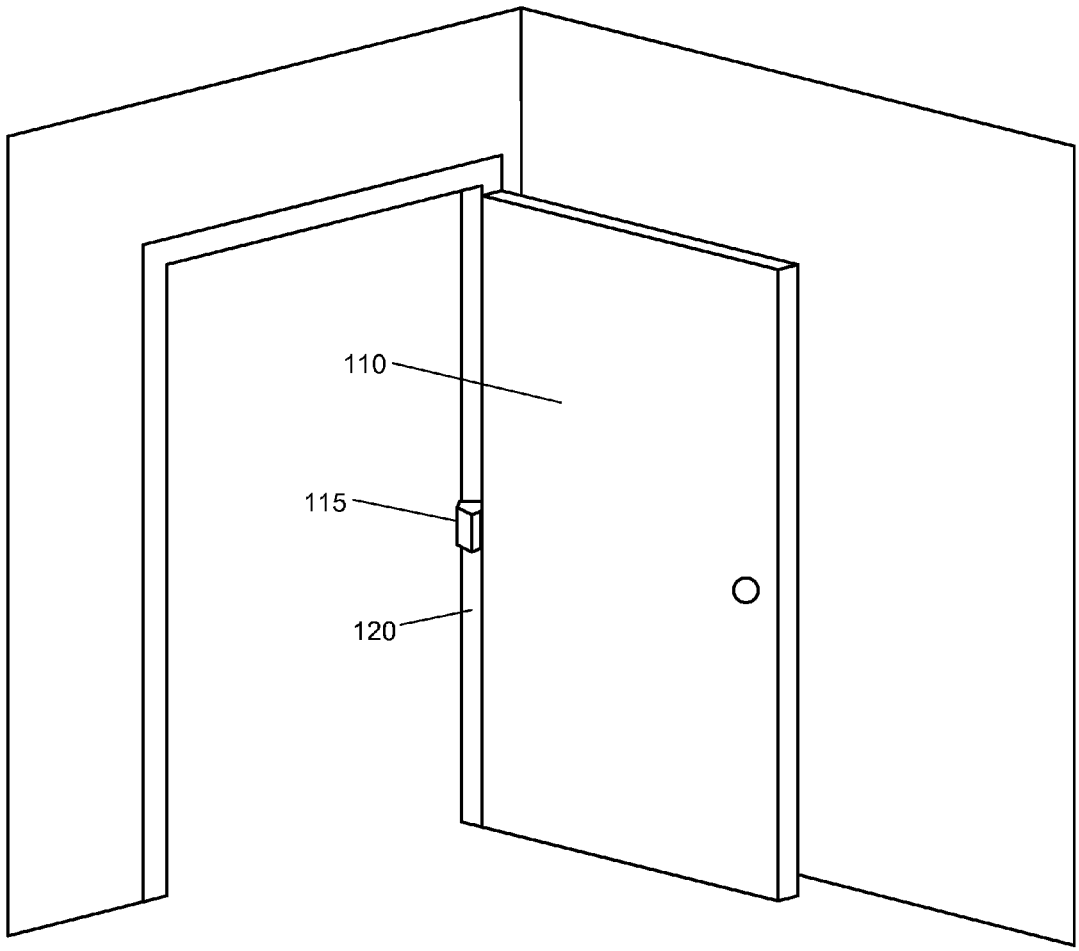
FIG. 1 is a perspective view of a door stop holding a door open.

FIG. 1 shows a door stop 115 according to one embodiment of the present invention. The door stop 115 can be positioned between a door 110 and a door frame 120 and can hold the door 110 in an open position. Some embodiments of the door stop 115 can be locked in order to lock the door 110 in an open position.

Figure 2:
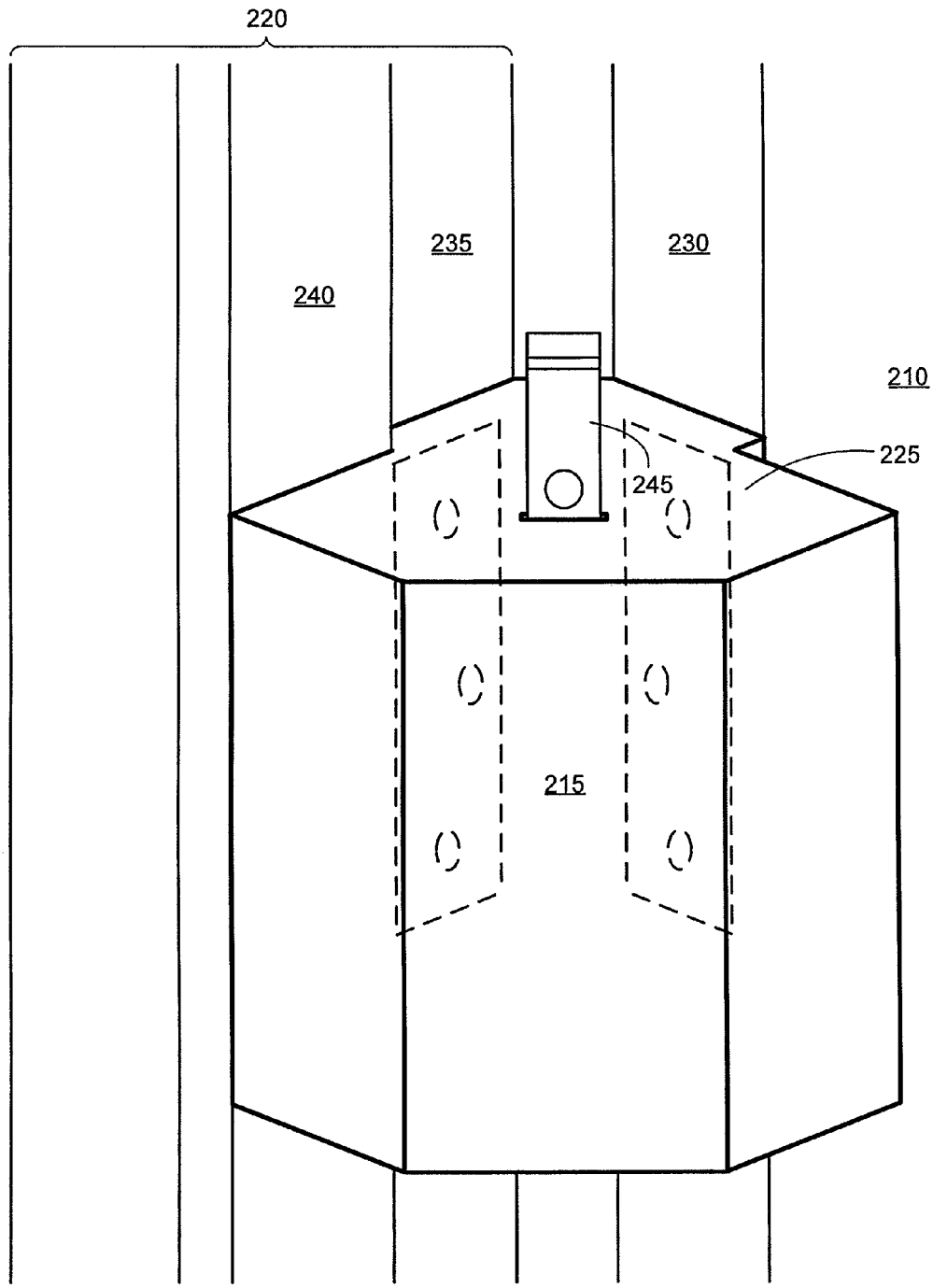
FIG. 2 is a perspective view of a door stop, a door, and a door frame.

FIG. 2 provides a close-up view of a door stop 215 similar to that of FIG. 1. The door stop 215 of FIG. 2 is positioned between a door 210 and a door frame 220. The door stop 215 can include a base 225, which can act as a wedge between the door 210 and the door frame 220. Surfaces of the base 225 can contact the hinged edge 230 of the door 210 (and/or corresponding hinge plate), the jamb 235 of the door frame 220 (and/or corresponding hinge plate), and the frame stop 240 of the door frame 220. The door stop 215 can include fastening equipment 245, which can secure the base 225 between the door 210 and the door frame 220.

With the door stop 215 positioned between the door 230 and the door frame 220, the door stop 215 can hold the door in an open position. If one were to attempt to close the door 210 with the door stop 215 in this position, the hinged surface 230 would impart a force to the base 225. In response, the base 225 would impart a force to the jamb 235 and the frame stop 240, and the fastening equipment 245 would impart a force to a hinge (not shown) connecting the door 210 and the door frame 220. The functionality of fastening equipment is discussed in greater detail in connection with FIGS. 4A-4B.

The base 225 and the fastening equipment 245 of the door stop 215 may be made of materials that allow the base 225 and fastening equipment 245 to maintain their structural integrity when exposed to the forces discussed above. For example, the base 225 may be made of a variety of kinds of polymers, aluminum, steel, wood, or other similar materials, and the fastening equipment 245 may be made of steel, aluminum, or other similar materials.

Figure 3A:
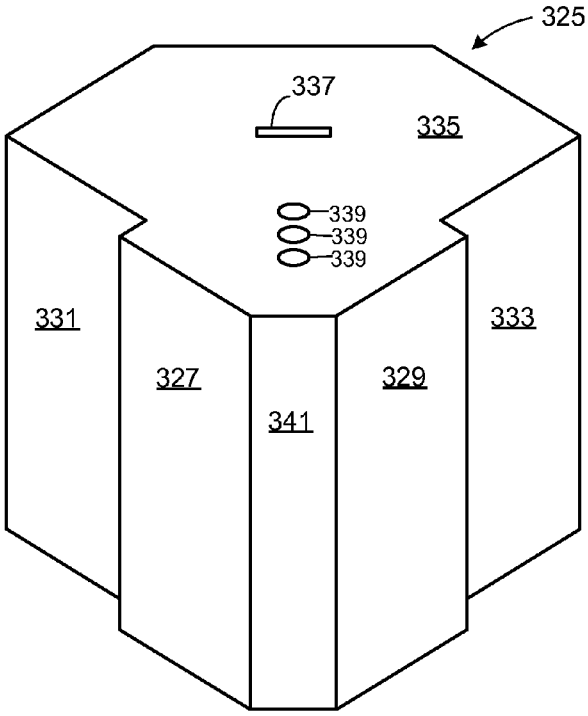
FIG. 3A is a perspective view of a base that can be used in some door stops.
Figure 3B:
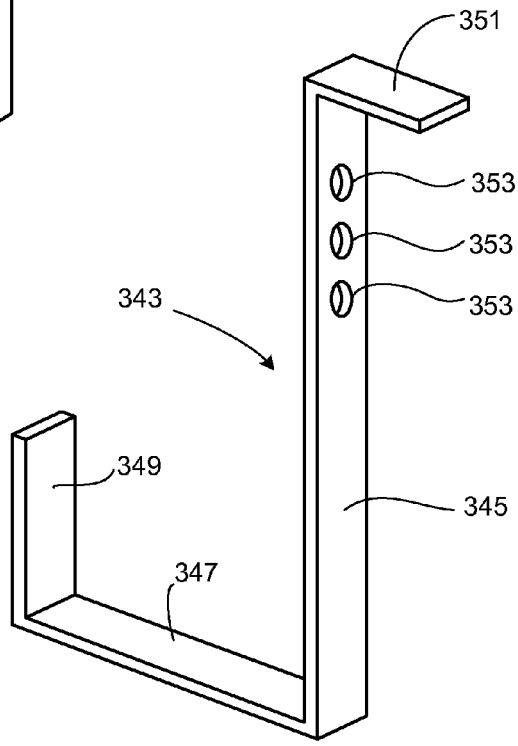
FIG. 3B is a perspective view of a slide that can be used in some door stops.
Figure 3C:
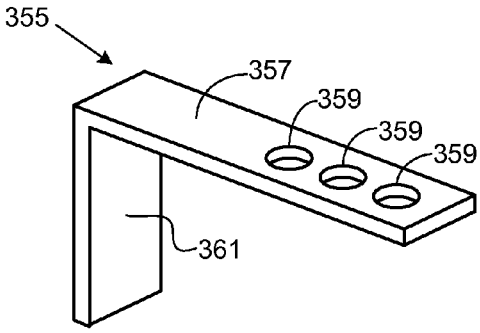
FIG. 3C is a perspective view of a bracket that can be used in some door stops.

FIGS. 3A-3C show components of a door stop according to some embodiments of the present invention. FIG. 3A shows a base 325 that is similar to that of FIG. 2. Referring again to FIG. 3A, the base 325 can have two jamb/door surfaces 327, 329, each of which can contact a door or a jamb (and/or corresponding hinge plates) when in use, depending on whether the door is a right-swinging door or a left-swinging door. The base 325 can have a left stop surface 331 and a right stop surface 333. If the door is a right-swinging door (i.e., is able to be pulled open to the right), the right stop surface 333 can contact the frame stop when in use, and the left stop surface 331 can be exposed. If the door is a left-swinging door (i.e., is able to be pulled open to the left), the left stop surface 331 can contact the frame stop when in use, and the right stop surface 333 can be exposed. Some bases can be approximately symmetrical. Some such bases can be equipped to be used with both right-swinging and left-swinging doors. Some bases can be asymmetrical. Some such bases can be specially configured for either right-swinging doors or left-swinging doors. In some embodiments, the base can be configured with little or nothing in terms of jamb/door surfaces, and the rear surface can extend approximately directly from the rear edge of the stop surface that is generally perpendicular to stop surface 331 to the rear edge of the stop surface that is generally perpendicular to stop surface 333.

In some embodiments, the jamb/door surfaces 327, 329 can be oriented relative to each other to hold doors open at a desired angle. For instance, a user desiring to hold a door open at a 90° angle could select a base in which the angle between the jamb/door surfaces 327, 329 was 90°. Users who desire to hold doors open at angles other than 90° can select bases that have jamb/door surface orientations to match their desired angles.

The base 325 of FIG. 3A includes additional surfaces, which can perform additional functions. The base 325 can include a top surface 335, which can include a slot 337 and apertures 339 for accommodating fastening equipment. The slot 337 can run all the way through the bottom of the base 325. The slot 337 and the apertures 339 of FIG. 3A are discussed in greater detail in connection with FIGS. 3B and 3C. Referring again to FIG. 3A, the base 325 can include a rear surface 341. In some embodiments, the rear surface 341 can be configured to allow clearance for a door hinge post, thereby allowing the base 325 to be positioned between a door and a door frame in close proximity to a hinge post. In some embodiments, a front surface can extend directly between the forward edges of the frame stop surfaces. In some embodiments, such as that shown in FIGS. 2 and 3A, the base may include multiple front surfaces that extend between the forward edges of the frame stop surfaces. In some embodiments, a curved front surface may extend between the forward edges of the frame stop surfaces 331, 333. In some embodiments, the front surface (or other surface) includes a handle to allow a user to easily position the door stop. Many additional variations on the shape of the base are possible.

FIGS. 3B and 3C show examples of fastening equipment that can be used in some embodiments of the present invention. FIG. 3B shows a slide 343. The slide 343 can include a shaft 345, which can be configured to move vertically within the slot 337 of the base 325 relative to the base 325. The slide 343 can include a bottom member 347, which, in some instances, can limit the slide's 343 upward movement by contacting the bottom surface of the base 325. In some instances, the bottom member 347 can limit the slide's 343 upward movement by contacting a hinge. In some embodiments, the bottom member 347 can be attached to a bottom clip 349, the functions of which are discussed in greater detail in connection with FIGS. 4A and 4B. Referring again to FIG. 3B, the slide 343 can include a stop 351, which can limit the slide's 343 downward movement by contacting the top surface 335 of the base 325. In some embodiments, the stop 351 and the shaft 345 can be formed by (a) inserting a strip of material (e.g., sheet metal) into the slot 337 on the bottom surface of the base 325, (b) sliding the strip of material all the way through the slot 337 so that it extends past the top surface 335 of the base 325, and (c) bending the strip of material to create a shaft 345 and a stop 351. In some embodiments, the slide can include multiple components. For example, the stop can be a separate, detachable component that is easily replaceable in the event of damage to some portion of the slide. In such examples, the separate stop can be attached to the remainder of the slide via a bolt, a rivet, or other common fasteners. The slide 343 can include apertures 353, one or more of which may extend past the top surface 335 of the base 325 when the slide 343 is in its uppermost position. In some embodiments, a user can lock the slide in (or near) its uppermost position by inserting a locking device (e.g., a pad lock) through one of the apertures 353 (e.g., the lowermost aperture 353 that extends past the top surface 335 of the base 325). Locking the slide is discussed in greater detail in connection with FIG. 4A.

FIG. 3C shows a bracket 355, which can be rigidly attached to the top surface 335 of the base 325. The bracket 355 can include a top member 357 having apertures 359 that are configured to align with the apertures 339 on the top surface 335 of the base 325. With the bracket apertures 359 and the base apertures 339 aligned, the bracket 355 can be attached to the base 325 with an ordinary fastener (e.g., a screw). In some embodiments, the top member 357 can be attached to a top clip 361, the functions of which are discussed in greater detail in connection with FIGS. 4A and 4B.

Figure 4A:
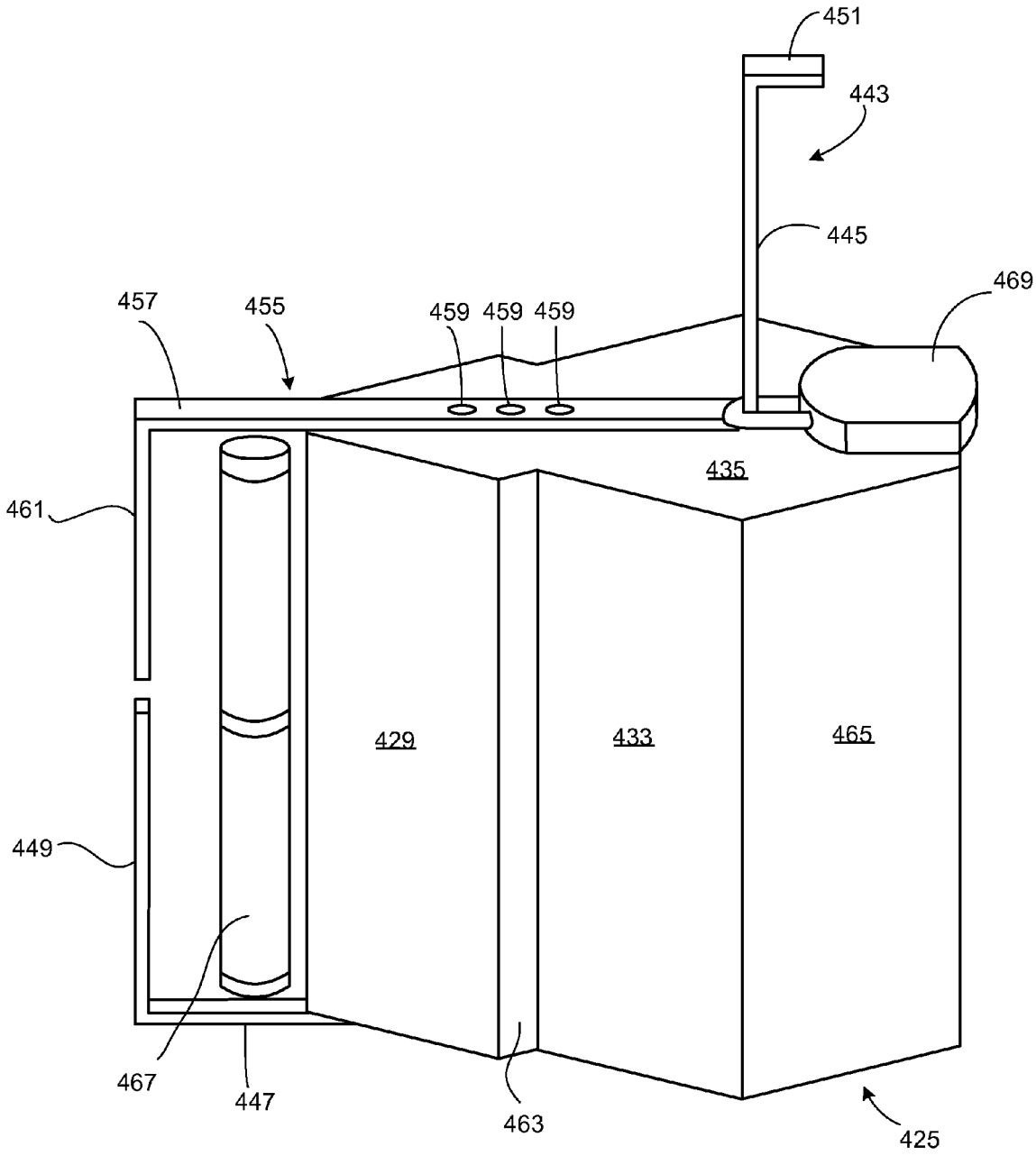
FIG. 4A is a perspective view of a door stop in a locked position over a hinge post.
Figure 4B:
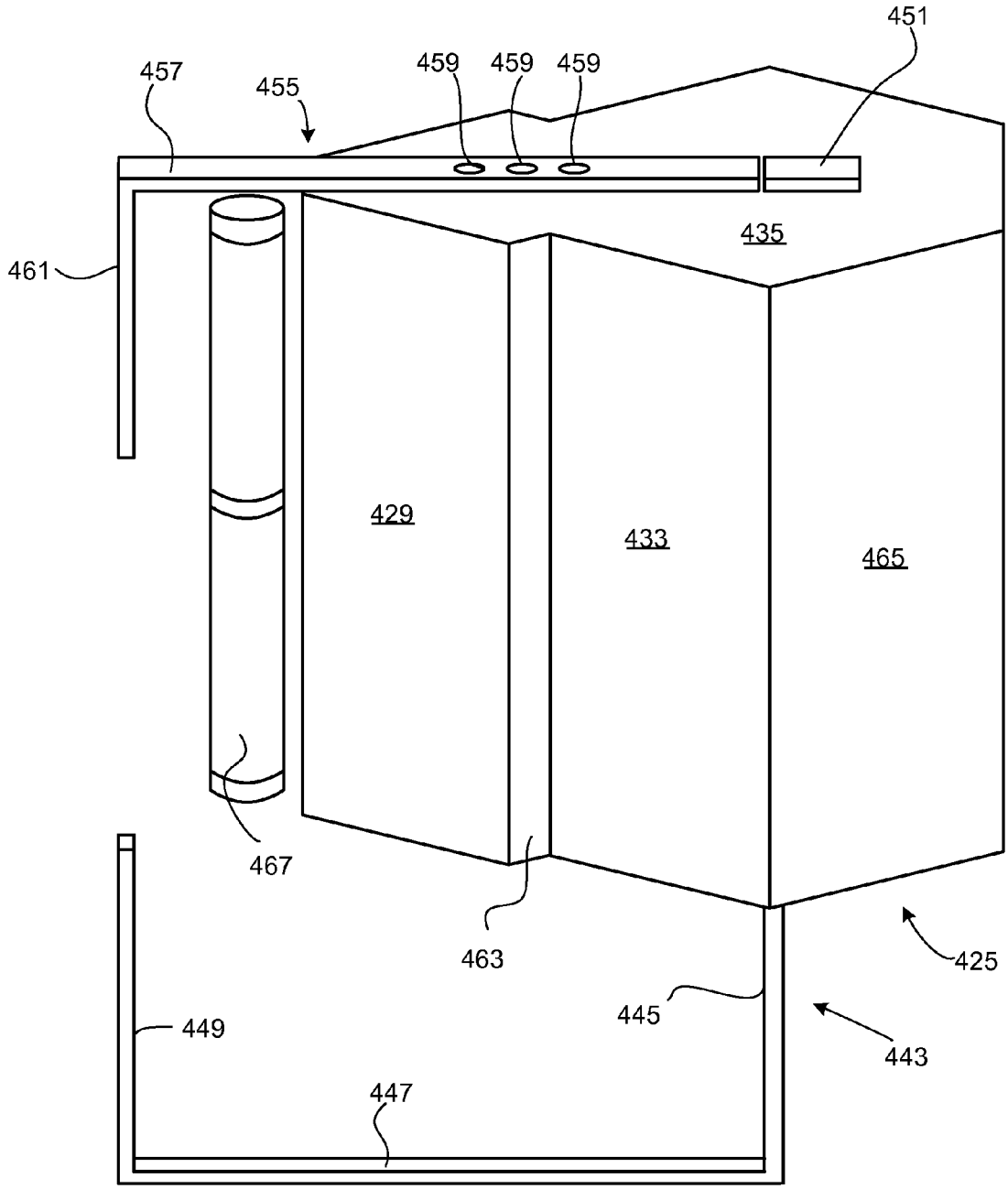
FIG. 4B is a perspective view of a door stop in an unlocked position over a hinge post.

FIG. 4A shows a door stop similar to that of FIGS. 3A-3C in a locked position, and FIG. 4B shows the door stop of FIG. 4A in an unlocked position. In FIG. 4A, the top clip 461 and the bottom clip 449 are positioned so as to confine a door hinge 467. In this position, if the door were a left-swinging door, the hinged edge of the door (and/or corresponding hinge plate) could contact the jamb/door surface 429. In this position, if the door were a right-swinging door, the door jamb (and/or corresponding hinge plate) would contact the jamb/door surface 429, and the door stop would contact the two stop surfaces 433, 463. If one were to try to close such a right-swinging door, both the hinged edge of the door and the jamb (and/or corresponding hinge plates) would tend to push the base 425 away from the hinge 467. In some embodiments, such movement of the base 425 can be resisted by frictional forces between the hinged edge (and/or corresponding hinge plate) and the left jamb/door surface and between the jamb (and/or corresponding hinge plate)

and the right jamb/door surface 429. In some embodiments, such movement of the base 425 can be resisted by the top clip 461 and/or the bottom clip 449 contacting the hinge 467. In some embodiments, such movement of the base 425 can be resisted by the side of the frame stop contacting stop surface 463. Embodiments in which the frame stop contacts stop surface 463 in order to resist movement of the base 425 away from the hinge 467 can protect the hinge 467 from undue wear. In some embodiments, such movement of the base 425 can be resisted by some combination of the aforementioned frictional forces, the top clip 461 and/or bottom clip 449 pressing against the hinge 467, the side of the frame stop pressing against stop surface 463, or other suitable means. If one were to try to close a door being held open by a door stop in which the side of the frame stop contacts stop surface 463, the door stop embodiment would tend to rotate. Such door stops can be designed to wedge relatively tightly between the door frame and the door such that forces exerted by the jamb and frame stop against jamb/door surface 429 and stop surface 433, respectively, would tend to counteract such rotation.

To position the door stop of FIG. 4A in the locked position, the bracket 455 can be positioned over the hinge 467, the surfaces of the base 425 can be positioned to contact the door and the door frame (and/or corresponding hinge plates), and the slide 443 can be moved to its uppermost position. A portion of the shaft 445 can extend above the top surface 435 of the base 425, and the slide 443 can be locked in place. In some embodiments, a pad lock 469 can be looped through an aperture in the shaft 445, thereby preventing the shaft 445 from moving downward relative to the base 425. In some embodiments, such as that of FIG. 3B, the shaft 445 can include multiple apertures, which can allow the door stop to accommodate hinges of multiple sizes. For example, shaft 445 can include three apertures—one to accommodate a 3.5-inch (8.89-centimeter) hinge, one to accommodate a 4-inch (10.16-centimeter) hinge, and one to accommodate a 4.5-inch (11.43-centimeter) hinge.

Referring to FIG. 4B, to position the door stop in the unlocked position, the shaft 443 can be unlocked and slid to its lowermost position. With the door stop in the unlocked position, the bracket 455 can be removed from the hinge 467, and the base 425 can be removed from contacting the door and the door frame (and/or corresponding hinge plates), thereby allowing the door to open and close freely.

Figure 5:
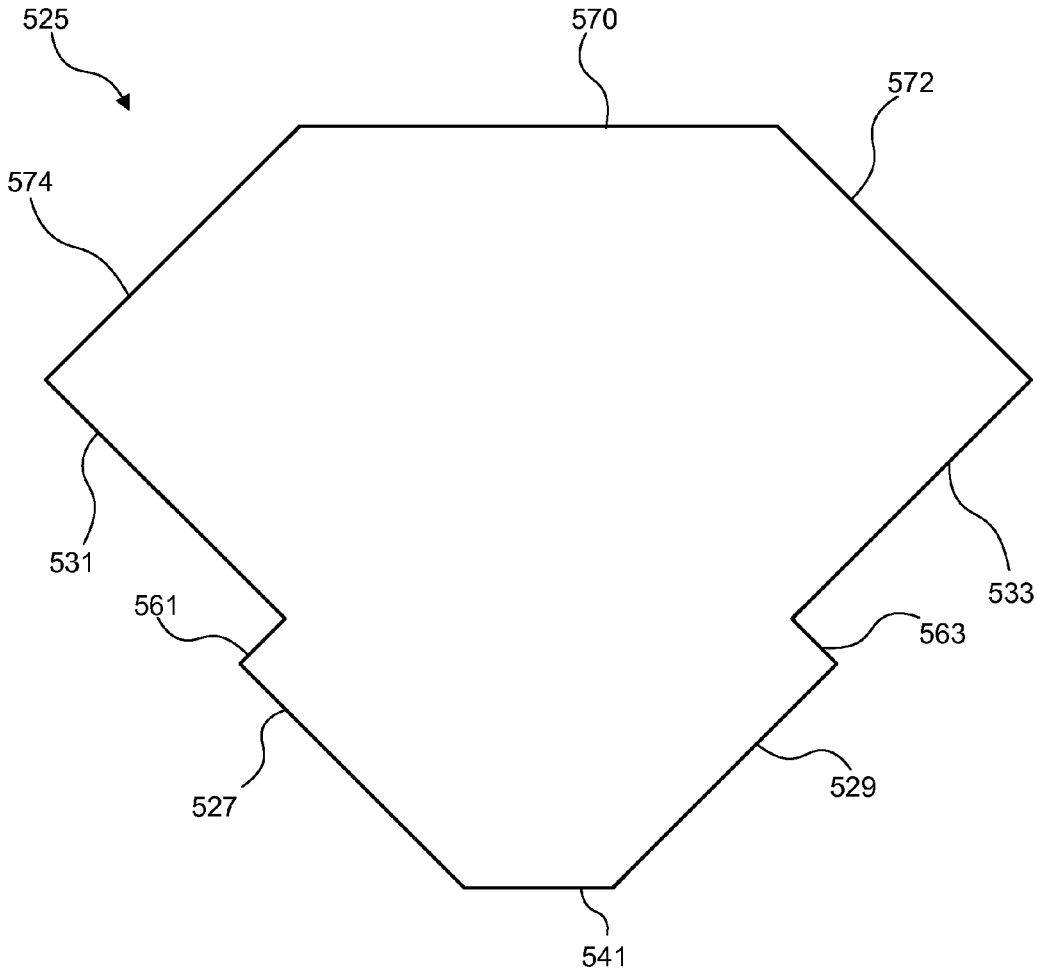
FIG. 5 is a top view of a base that can be used in some door stops.

FIG. 5 shows a top view of a base 525 that can be used in some embodiments of the present invention. In some embodiments, the length of rear surface 541 can be approximately 0.875 inches (2.2225 centimeters), the length of jamb/door surfaces 527, 529 can be approximately 1.875 inches (4.7625 centimeters), the length of frame stop surfaces 561, 563 can be approximately 0.375 inches (0.9525 centimeters), the length of frame stop surfaces 531, 533 can be approximately 2.000 inches (5.08 centimeters), the length of front surfaces 572, 574 can be approximately 2.125 inches (5.3975 centimeters), and the length of front surface 570 can be approximately 2.8125 inches (7.14375 centimeters). In some embodiments, the door stop can be approximately 4 inches (10.16 centimeters) from top to bottom.

Door stop embodiments can include a variety of features. In some embodiments, a top member, a top clip, and a base can be integrally formed of the same material. In some embodiments, the base can have a recess configured to house the bracket, which can provide increased stability to the connection between the base and the bracket. Door stop embodiments can include a wide variety of locking mechanisms. For example, some embodiments can include an internal locking mechanism, which can be configured to prevent the slide from moving relative to the base when actuated. Some such embodiments can be electronically actuated. In some door stop embodiments, the locking mechanism can be an internal ratchet-type mechanism, allowing the slide to lock into place automatically as it is moved upward. In some embodiments, the slide is movable upwardly and downwardly relative to the base, but the uppermost portion of the slide is not able to extend above the base. In some embodiments, neither the bracket nor the slide is capable of extending above or below the base. Some such embodiments are able to provide a relatively long stop surface for preventing the base from moving away from the hinge post while maintaining a relatively small total size. In some such embodiments, a channel can extend along the bottom surface of the base through which the slide is capable of moving. Some door stop embodiments include fastening equipment that swings between locked and unlocked positions on hinges that are oriented perpendicularly to the door hinge.

For ease of illustration, the terms upward and downward, uppermost and lowermost, top and bottom, above and below, right and left, and others, are used with reference to the objects they describe in the corresponding figures, but of course door stops can be oriented in any direction depending on the user's preference and/or the particular application. For example, a user may use the door stop of FIGS. 4A-4B in an upside-down manner, positioning the bottom member 447 and the bottom clip 449 over the top of the hinge 467 and sliding the base 425 and the bracket 455 upward relative to the slide 443 so that the top clip 461 combines with the bottom clip 449 to confine the hinge 467.

Thus, embodiments of the security door stop are disclosed. One skilled in the art will appreciate that the security door stop can be practiced with embodiments other than those disclosed. The disclosed embodiments are presented for purposes of illustration and not limitation, and the present invention is limited only by the claims that follow.

What is claimed is:

1. A door stop for locking doors open, comprising: a base having opposite symmetric sides, a front surface and upper and lower surfaces, wherein one side has a first contact surface and the other side having a second contact surface the base being positionable in an open position in which a) the first contact surface contacts a door jamb, a first hinge plate of a hinge, or both b) the second contact surface contacts a hinged edge of a door, a second hinge plate of the hinge, or both, the base further comprises third and fourth contact surfaces at each side, wherein each third contact surface is generally perpendicular to respective first and second contact surfaces and each fourth contact surface is generally parallel to respective first and second contact surfaces, the third contact surfaces are adapted to contact a surface of a frame stop and the fourth contact surfaces are adapted to contact another surface of the frame stop;

first and second fastening members coupled to the base, the first fastening member being movable relative to the base between a confining position and a non-confining position when the base is in the open position, the first and second fastening members (a) confining the hinge when the fastening members are in the confining position and (b) not confining the hinge when the fastening members are in the non-confining position, the base being adapted to hold the door open at an angle formed by the first and second contact surfaces when the fastening members are in the confining position; and a locking mechanism coupled to the first fastening member and adapted to lock the first fastening member in the confining position, thereby preventing the base from being removed from the open position and locking the door open at the angle formed by the first and second contact surfaces.

2. The door stop of claim 1, wherein the base is generally symmetrical about an axis that makes an approximately 45-degree angle with both the first and second contact surfaces.

3. The door stop of claim 1, wherein the first fastening member is proximate a lower portion of the hinge and the second fastening member is proximate an upper portion of the hinge when the first fastening member is in the confining position.

4. The door stop of claim 1, wherein the first fastening member is slidably coupled to the base.

5. The door stop of claim 1, wherein the locking mechanism is a pad lock.

6. The door stop of claim 1, wherein the base defines a substantially vertical slot, and the first fastening member comprises a slide extending within the slot, the slide including a clip proximate a portion of the hinge when the first fastening member is in the confining position.

7. The door stop of claim 6, wherein the slot extends between and through the upper and lower surfaces of the base, and the slide further includes a member adapted to contact the base, thereby limiting vertical movement of the slide relative to the base.

8. The door stop of claim 7, wherein the slide further includes a shaft connected on a first end to the member and defining a plurality of apertures on a second opposite end, the second end adapted to extend from the base when the member contacts the base.

9. The door stop of claim 1, wherein the angle formed by the first and second contact surfaces is approximately go degrees.

10. A door stop for locking doors open, comprising:

a base having a front surface, upper and lower surfaces, and first and second contact surfaces, the base defining a substantially vertical slot the base being positionable in an open position in which the first contact surface contacts a door jamb, a first hinge plate of a hinge, or both and the second contact surface contacts a hinged edge of a door, a second hinge plate of the hinge, or both;

first and second fastening members coupled to the base, the first fastening member being movable relative to the base between a confining position and a non-confining position when the base is in the open position, the first and second fastening members (a) confining the hinge when the first fastening member is in the confining position and (b) not confining the hinge when the first fastening member is in the non-confining position, wherein, when the first fastening member is in the confining position, the first fastening member is proximate a lower portion of the hinge, and the second fastening member is proximate an upper portion of the hinge, the first fastening member comprising a slide extending within the slot between and through the upper and lower surfaces of the base, the slide including (i) a bottom clip proximate the lower portion of the hinge when the first fastening member is in the confining position and (ii) a bottom member adapted to contact the bottom surface of the base, thereby limiting upward vertical movement of the slide relative to the base, the base being adapted to hold the door open at an angle formed by the first and second contact surfaces when the first fastening member is in the confining position; and a locking mechanism coupled to the first fastening member and adapted to lock the first fastening member in the confining position, thereby preventing the base from being removed from the open position and locking the door open at the angle formed by the first and second contact surfaces.

11. The door stop of claim 10, wherein the slide further includes (iii) a shaft connected on a lower end to the member and defining a plurality of apertures on an upper end, the upper end adapted to extend from the base when the member contacts the bottom surface of the base.

12. The door stop of claim 10, wherein the first fastening member is slidably coupled to the base.

13. The door stop of claim 10, wherein the locking mechanism is a pad lock.

14. The door stop of claim 10, wherein the angle formed by the first and second contact surfaces is approximately go degrees.

15. A door stop for locking doors open, comprising: a base having opposite symmetric sides, a front surface and upper and lower surfaces, wherein one side has a first contact surface and the other side having a second contact surface the base being positionable in an open position in which a) the first contact surface contacts a door jamb, a first hinge plate of a hinge, or both b) the second contact surface contacts a hinged edge of a door, a second hinge plate of the hinge, or both, the base further comprises third and fourth contact surfaces at each side, wherein each third contact surface is generally perpendicular to respective first and second contact surfaces and each fourth contact surface is generally parallel to respective first and second contact surfaces, the third contact surfaces are adapted to contact a surface of a frame stop and the fourth contact surfaces are adapted to contact another surface of the frame stop;

fastening means for (a) confining the hinge when the base is in the open position and the fastening means are in a confining position and (b) not confining the hinge when the fastening means are not in the confining position, the base being adapted to hold the door open at an angle formed by the first and second contact surfaces when the fastening means is in the confining position; and locking means for locking the fastening means in the confining position, thereby preventing the base from being removed from the open position and locking the door open at the angle formed by the first and second contact surfaces.

16. The door stop of claim 15, wherein the first contact surface is generally perpendicular to the second contact surface.

17. The door stop of claim 16, wherein the base is generally symmetrical about an axis that makes an approximately 45-degree angle with both the first and second contact surfaces.

* * * * *